US005981037A

United States Patent [19]

Patel et al.

[11] Patent Number: 5,981,037

[45] Date of Patent: Nov. 9, 1999

[54] PATTERNED BONDING OF ENCAPSULATION MATERIAL TO AN INSULATION ASSEMBLY

[75] Inventors: Bharat D. Patel, Reynoldsburg; Steven G. Schmitt, Newark; Michael T. Heffelfinger, Westerville, all of Ohio; Rebecca L. Thomas-Dutiel, Surfside Beach, S.C.; Weigang Qi, Westerville, Ohio

[73] Assignee: Owens Corning Fiberglas Technology, Inc., Summit, Ill.

[21] Appl. No.: 09/016,857

[22] Filed: Jan. 30, 1998

[51] Int. Cl.[6] ..... B32B 3/06

[52] U.S. Cl. ..... 428/196; 428/201; 428/74

[58] Field of Search ..... 428/74, 201, 198, 428/200, 196; 52/406.2

[56] References Cited

U.S. PATENT DOCUMENTS

| | | |
|---|---|---|
| 3,567,162 | 3/1971 | Lea . |
| 3,900,632 | 8/1975 | Robinson . |
| 4,238,257 | 12/1980 | Remi et al. . |
| 4,242,409 | 12/1980 | Parker . |
| 4,726,985 | 2/1988 | Fay et al. . |
| 4,956,218 | 9/1990 | Haining . |
| 5,106,447 | 4/1992 | DiRado et al. . |
| 5,108,821 | 4/1992 | Dooley et al. . |
| 5,277,955 | 1/1994 | Schelhorn et al. . |
| 5,362,539 | 11/1994 | Hall et al. . |
| 5,421,133 | 6/1995 | Berdan, II et al. . |
| 5,486,401 | 1/1996 | Grant et al. . |
| 5,545,279 | 8/1996 | Hall et al. . |
| 5,733,624 | 3/1998 | Syme et al. . |
| 5,746,854 | 5/1998 | Romes et al. . |

FOREIGN PATENT DOCUMENTS

| | | |
|---|---|---|
| WO97/07968 | 3/1997 | WIPO . |
| WO97/08401 | 3/1997 | WIPO . |

*Primary Examiner*—Alexander Thomas
*Attorney, Agent, or Firm*—Inger H. Eckert

[57] ABSTRACT

An insulation assembly includes an elongated batt of fibrous insulation material having a top end and a bottom end, and a facing secured on a major surface. The facing is secured to the major surface by a series of spaced apart adhesive ribbons, wherein the adhesive ribbons are oriented generally transversely of the insulation assembly, and are nonlinear in a generally downwardly-oriented concave shape.

16 Claims, 4 Drawing Sheets

PATTERNED BONDING OF ENCAPSULATION MATERIAL TO AN INSULATION ASSEMBLY

TECHNICAL FIELD AND INDUSTRIAL APPLICABILITY OF THE INVENTION

This invention relates to insulation products, and in particular those insulation products of the type suitable for insulating buildings. More specifically, this invention pertains to insulation products enclosed in encapsulation material to assist in handling the insulation products.

BACKGROUND OF THE INVENTION

Fibrous insulation is typically formed by fiberizing molten material and depositing the fibers on a collecting conveyor. Most, but not all fibrous insulation products contain a binder material to bond the fibers together, forming a lattice or network. The binder gives the insulation product resiliency for recovery after packaging, and provides stiffness and handleability so that the product can be handled and applied as needed in the insulation cavities of buildings. The fibrous insulation is cut into lengths to form insulation products, and the insulation products are packaged for shipping.

One typical insulation product is an insulation batt, usually about 8 feet long, and generally suitable for use as wall insulation in residential dwellings, or as insulation in the attic and floor cavities in buildings. In many insulation applications a vapor barrier is needed on one side or face of the insulation to prevent moisture-laden air from the warm interior of the dwelling from entering the insulation. Otherwise, the water vapor in the warm interior air cools and condenses within the insulation, thereby creating a wet insulation product which can have difficulty performing at its designed efficiency. Vapor barriers are typically created with a layer of asphalt in conjunction with a kraft paper or foil facing. Vapor barrier insulation products are commonly used to insulate walls, floors or ceilings that separate a warm interior space from a cold exterior space.

There are some insulation product requirements that call for insulation that is not vapor impermeable, but rather allows water vapor to pass through. For example, retrofit insulation products designed for adding additional insulation material on top of existing attic insulation should not have a vapor barrier. Also, insulation for wall cavities where the wall will have a separate full wall vapor barrier, such as a 4.0 mil polyethylene film on the interior or warm side of the wall, will not require a vapor barrier on the insulation product.

Recent advances in manufacturing insulation products have resulted in insulation materials that rely on encapsulation layers or films for containing and handling purposes, and do not require any binder material to bond the insulation fibers to each other. The encapsulation is particularly advantageous for binderless products or low binder products, although encapsulation provides benefits for many types of bindered products as well. An example of an encapsulated binderless product is disclosed in U.S. Pat. No. 5,227,955 to Schelhorn et al. Further, as disclosed in U.S. Pat. No. 5,545,279 to Hall et al., the insulation material can be encapsulated in an in-line process. The primary use for such encapsulated insulation products is attic insulation, although this type of insulation product can also be used in wall cavities or in underfloor ceiling cavities.

When applying encapsulation material to a fibrous batt the encapsulation material is attached to the fibrous batt by an adhesive layer or strip, such as a strip of hot melt adhesive applied in liquid form during manufacture of the insulation product. For example, the above-mentioned U.S. Pat. No. 5,277,995 to Schelhorn et al. discloses an encapsulated batt with an encapsulation material adhered with an adhesive that can be applied in longitudinal stripes, or in patterns such as dots, or in an adhesive matrix. The Schelhorn et al. patent also discloses that an alternative method of attachment is for the adhesive layer to be an integral part of the encapsulation film, which, when softened, bonds to the fibers in the batt.

A critical product attribute for building insulation products is the ability to resist or slow down the propagation of flames during a fire. It is important that building materials in general not be vehicles for rapid spread of flames or fire from one part of a building structure to another. Therefore, most building materials must meet flame spread limitations. A commonly used measure of the flame spread characteristics of a product is the ASTM E84 Tunnel Test for surface burning characteristics. In this test method a fire is generated at one end of a fire tunnel and the time required for the flames to spread 25 feet along the tunnel is measured. In another version of the test, the absolute distance along which the flames spread is measured. Another currently used test for the ability of insulation products to retard the spread of flames is the ASTM Radiant Panel Test. This test measures the flame spread characteristics of products subjected to radiation from a hot radiant panel suspended above the test specimen.

Various techniques have been proposed to reduce the flame spread of insulation products. One proposed solution is to incorporate fire retardant materials into the facing or encapsulation materials. Another method is to use an inorganic facing material, such as a foil material. Another solution is to employ inorganic adhesives to bind the encapsulation material to the fibrous batt. While some of these solutions can be effective in reducing the flame spread to acceptable levels, these solutions are generally relatively expensive.

It would be advantageous if there could be developed an economically acceptable means for reducing the flame spread of insulation products. Such insulation products should exhibit sufficiently low flame spread characteristics as to satisfy industry safety criteria, and should not appreciably raise the manufactured cost of the insulation product.

SUMMARY OF THE INVENTION

The above objects as well as other objects not specifically enumerated are achieved by an insulation assembly including an elongated batt of fibrous insulation material having a top end and a bottom end, and a facing secured on a major surface. The facing is secured to the major surface by a series of spaced apart adhesive ribbons, wherein the adhesive ribbons are oriented generally transversely of the insulation assembly, and are nonlinear in a generally downwardly-oriented concave shape.

According to this invention, there is also provided an insulation assembly including an elongated batt of fibrous insulation material having a top end and a bottom end, and a facing secured on a major surface. The facing is secured to the major surface by a series of spaced apart adhesive ribbons, wherein the adhesive ribbons are oriented generally transversely of the insulation assembly. The adhesive ribbons are nonlinear in a generally downwardly-oriented concave shape, and include opposed left and right portions connected together and oriented along generally straight lines.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

While the description and drawings disclose insulation assemblies of fiberglass insulation, it is to be understood that the insulation material can be any compressible fibrous insulation material, such as mineral wool.

Figure 1:
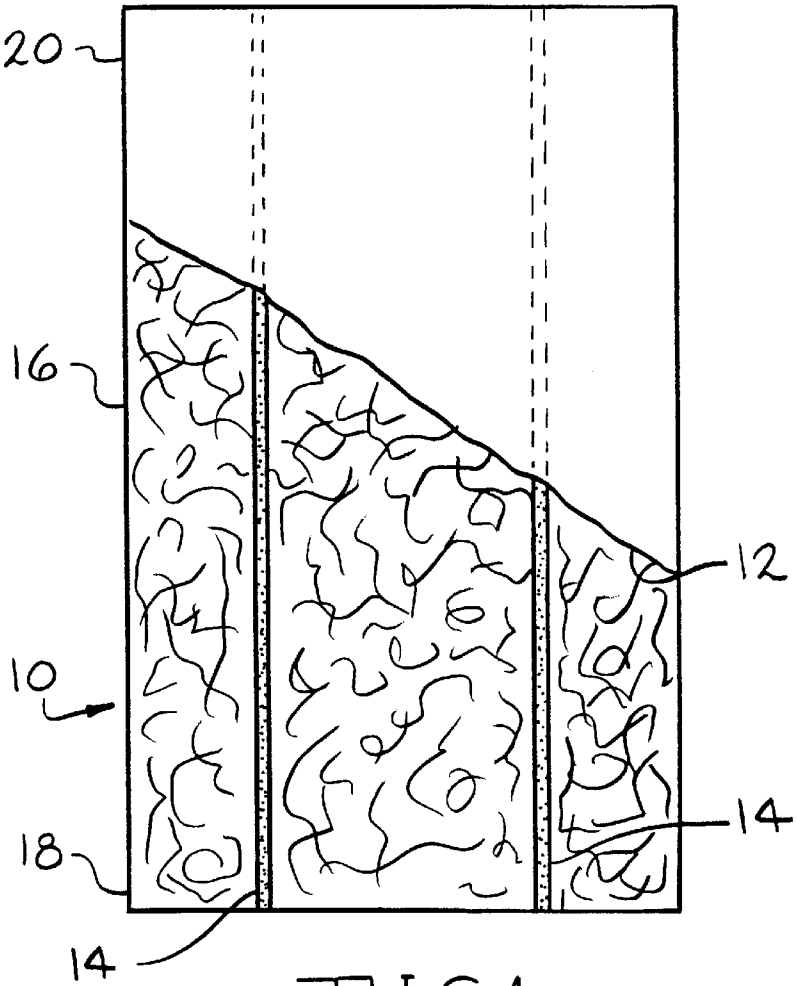
FIG. 1 PRIOR ART
FIG. 1 is a schematic plan view of an insulation assembly according to the prior art.

As shown in FIG. 1, the prior art encapsulated insulation assembly 10 is shown with the encapsulation material 12 partially cut away so that the adhesive ribbons 14, which bond the encapsulation material to the batt 16, are exposed. The adhesive ribbons are a hot melt adhesive. During a flame spread test in which the bottom 18 of the insulation assembly is exposed to a flame, the adhesive ribbons do not hinder the spread of flames from the bottom to the top 20 of the insulation assembly.

Figure 2:
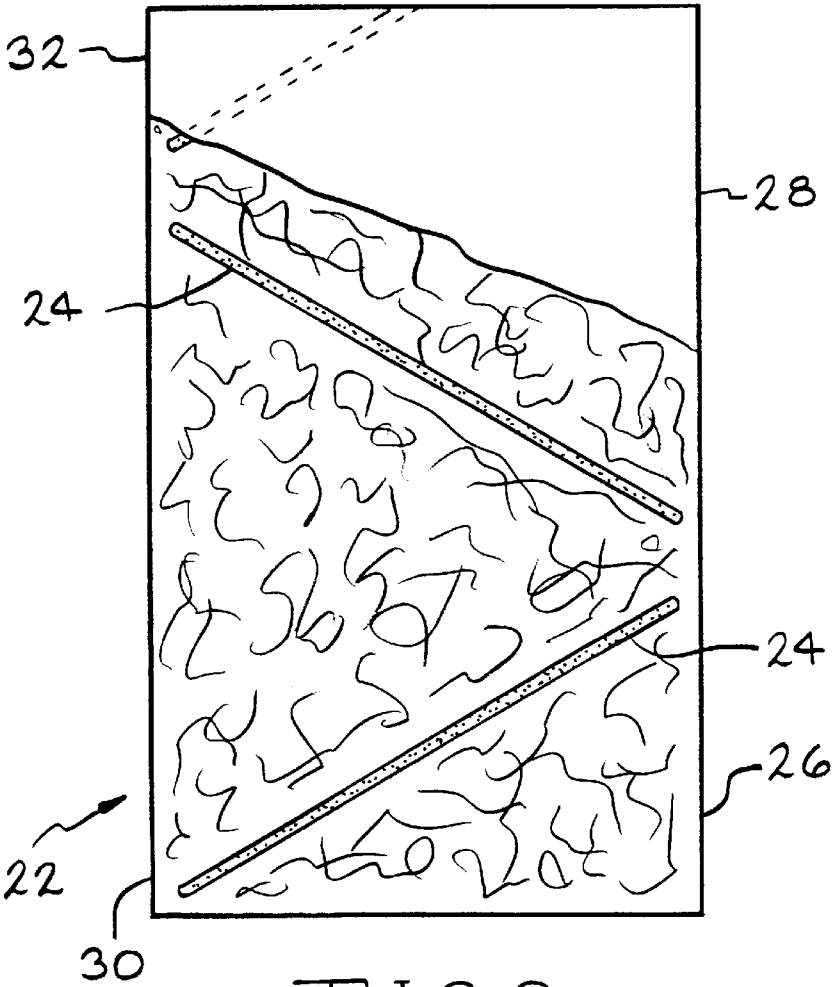
FIG. 2 PRIOR ART
FIG. 2 is a schematic plan view of another insulation assembly according to the prior art.

In an alternative form of an encapsulated insulation assembly 22 of the prior art, as shown in FIG. 2, the adhesive ribbons 24 are arranged on the batt 26 to adhere the encapsulation material 28 to the batt. The adhesive ribbons 24 are oriented on a diagonal, in a zigzag pattern. While this pattern of adhesive differs from that of FIG. 1, during a flame spread test in which the bottom 30 of the insulation assembly 22 is exposed to a flame, the adhesive ribbons 24 would not be expected to substantially hinder the spread of flames from the bottom to the top 32 of the insulation assembly.

Figure 4:
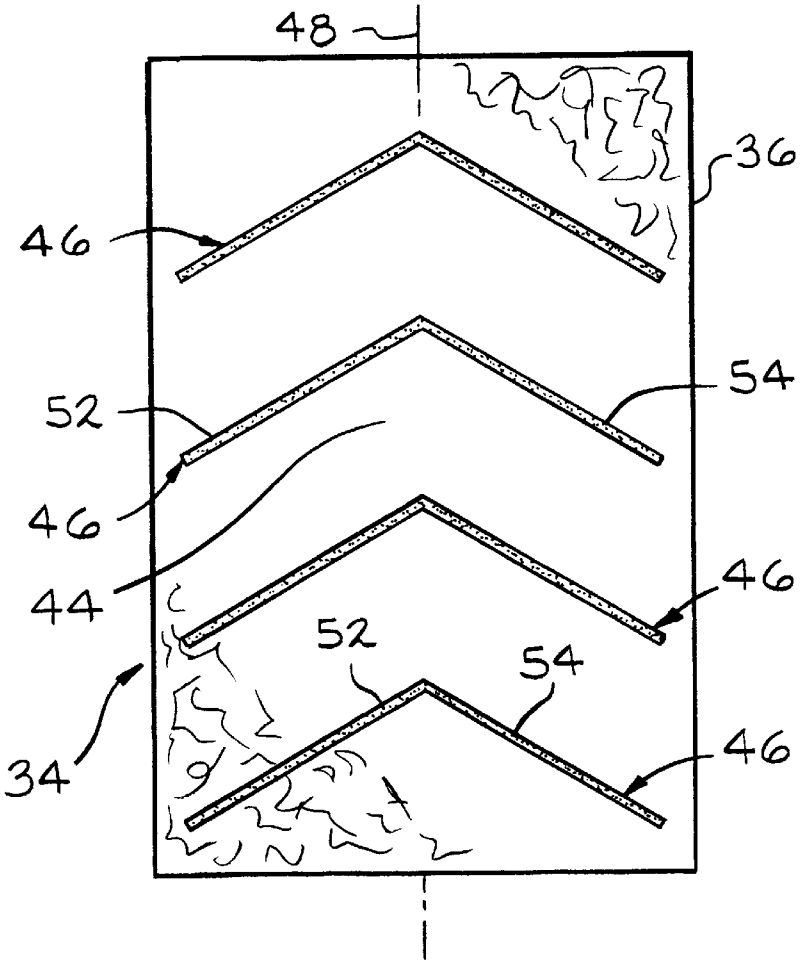
FIG. 4 is a schematic plan view of the insulation assembly of FIG. 3 with the encapsulation material removed.
Figure 3:
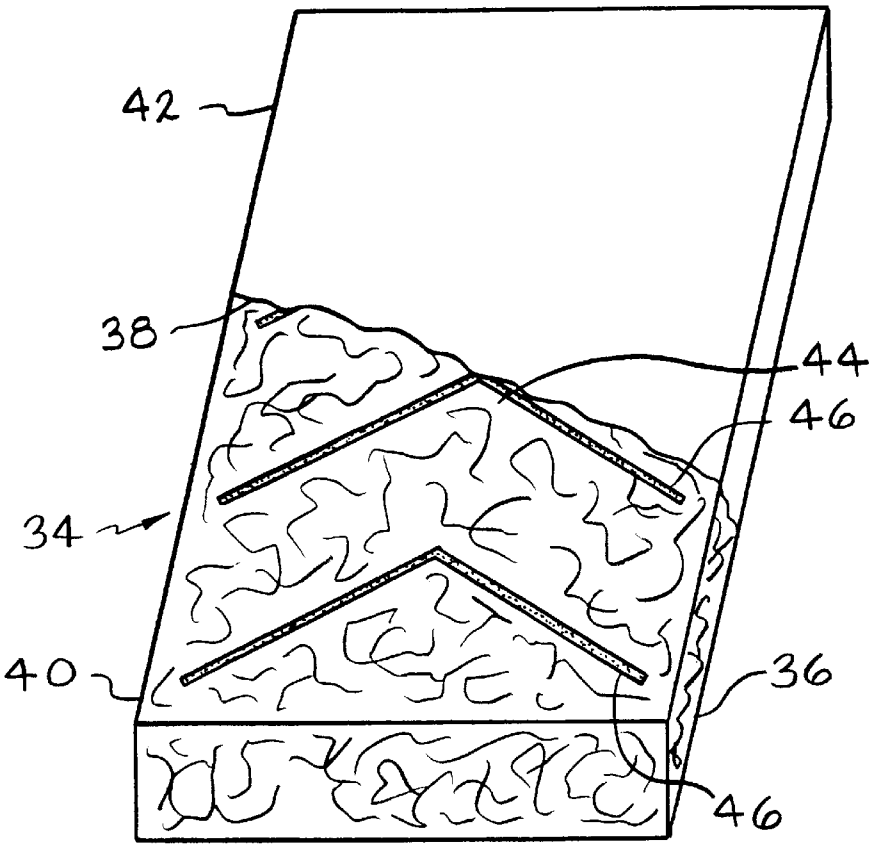
FIG. 3 is a schematic perspective view of an insulation assembly according to the present invention.

As shown in FIGS. 3 and 4, the insulation assembly of the invention is indicated at 34, and is made of an elongated insulation batt 36 and encapsulation material 38. The insulation assembly has a bottom end 40 and a top end 42. The manufacture of the glass fiber insulation batts 36 is well known technology, and those skilled in the art will be aware of several conventional methods for producing such batts. The glass fiber batts are preferably comprised of a light density insulation material, having a density within the range of from about 0.3 to about 1.0 pounds per square foot (pcf).

The encapsulation material 38 is preferably a polymer film, such as a polyethylene film, although other films such as a polypropylene film can be used. Coextruded films could also be used, with the two layers of the coextruded film having different softening points. The encapsulation material is preferably less than about 1.0 mil in thickness, and more preferably less than about 0.5 mil in thickness. The encapsulation material can be applied to the insulation batt by any suitable process. Apparatus suitable for directing and guiding the encapsulation material onto the glass fiber pack is disclosed in the above-mentioned U.S. Pat. No. 5,545,279 to Hall et al., which is hereby incorporated by reference.

The encapsulation material 38 is adhered to a major surface 44 of the insulation batt 36 by a series of spaced apart adhesive ribbons 46. The adhesive ribbons are oriented generally transversely of the insulation assembly, i.e., generally perpendicular to the longitudinal axis 48 of the insulation assembly. The ribbons are bent or curved to present a downwardly concave shape. As shown, the ribbons can be in a shape of a chevron, with angled left portion 52 and angled right portion 54, forming an apex 56. Although the opposed left and right portions 52 and 54 are shown as being connected together, they may be separated. Further, it is to be understood that the ribbons can be provided with small discontinuities that can affect the path of the fire or flames along the line of the ribbons. The angled left and right portions 52 and 54 form an angle that is preferably within the range of from about 120 degrees to about 170 degrees, although other angles may also be effective. Although not shown, the left and right portions can extend all the way to the edge of the batt. The number of adhesive ribbons and their spacing can vary. Preferably, the adhesive ribbons are spaced apart by at least 6 inches, and more preferably by a distance within the range of from about 10 to about 18 inches.

During a flame spread test, the bottom end 40 of the insulation assembly 34 is exposed to a flame, the flame attacks the encapsulation material 38. Regardless of whether or not the encapsulation material itself provides combustible material, the flames eventually reach the lowermost adhesive ribbon 46. Because of the downwardly concave shape of the adhesive ribbon, the advance of the burning of the left portion 52 will be toward the center of the insulation assembly, and the advance of the burning of the right portion 54 will be toward the center. When the burning traveling along the line of the left portion 54 meets the burning traveling along the line of the right portion, there will be a dramatic, sudden lack of fuel, and the advance of the fire or flames from the lowermost adhesive ribbon to the next higher adhesive ribbon will be prevented or at least delayed. In other words, the burning on the left and right will be curled or directed towards each other to retard the extension of the flames beyond the adhesive ribbon. Therefore, a series of spaced apart, chevron-shaped adhesive ribbons 46 will advantageously hinder the propagation or spread of flames from the bottom end 40 to the top end 44 of the insulation assembly.

Figure 7:
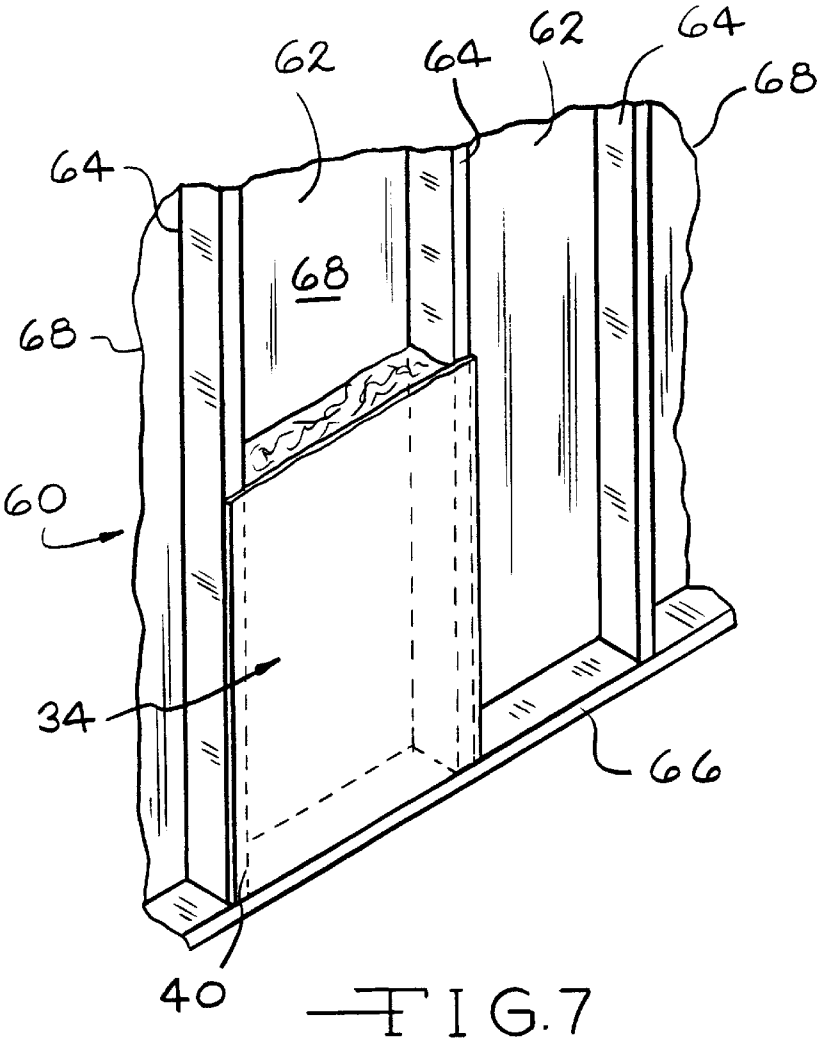
FIG. 7 is a schematic perspective view of the insulation assembly of FIG. 3 applied to a wall cavity in a building.

As shown in FIG. 7, a wall section, indicated at 60, includes several wall cavities 62 defined by studs 64, a header, not shown, a footer 66, and sheathing material 68. An insulation assembly 34 of the invention, shown partially cut away, is placed in one of the wall cavities 62 to provide an insulation assembly that can significantly retard the upward spread of flames from the bottom end 40 of the insulation assembly. When the insulation assembly 34 is positioned in a wall cavity as shown in FIG. 7, the adhesive ribbons are in a preferred orientation to inhibit the flames of a fire starting at the bottom end of the insulation assembly, with the generally downwardly concave shape oriented toward the source of the fire. Since it is not always possible to predict the origin or direction of a fire, there may be situations where the generally downwardly concave shape is oriented away from the source of the fire. It is believed that the transverse orientation of the adhesive ribbons would still substantially inhibit the spread of flames.

Figure 5:
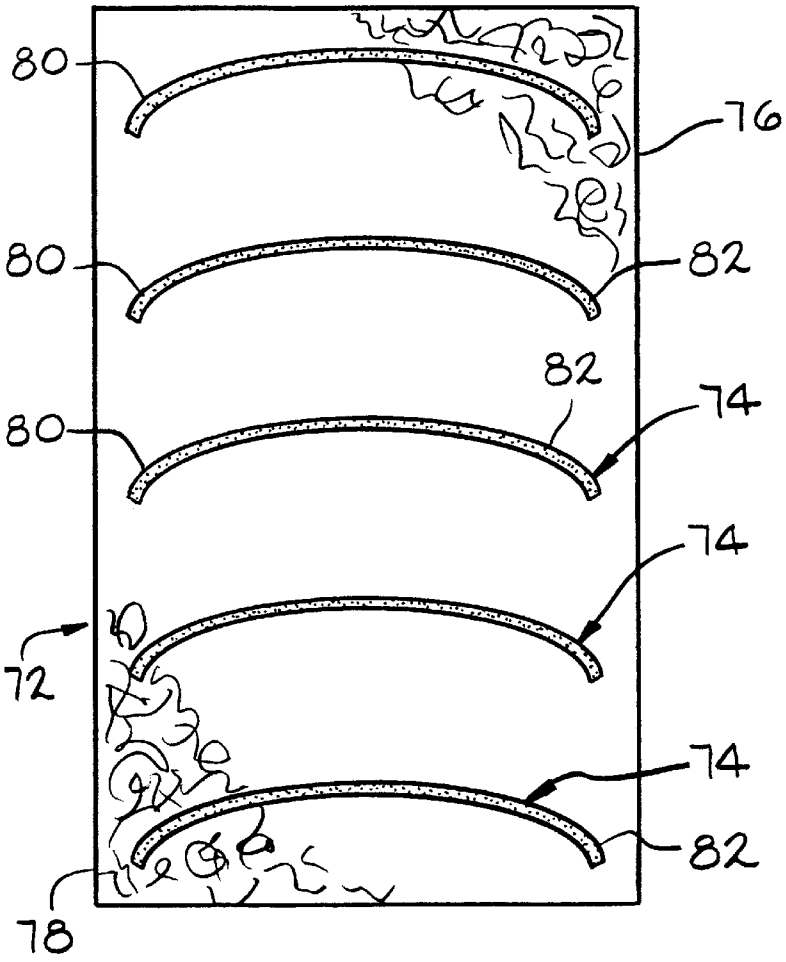
FIG. 5 is a schematic plan view similar to FIG. 4, illustrating a different pattern of adhesive material according to the present invention.

As shown in FIG. 5, the insulation assembly 72 includes curved adhesive ribbons 74 placed on the batt 76. The curved ribbons are generally downwardly concave in shape, with the concave portion facing the bottom end 78 of the insulation assembly 72. The adhesive ribbons 74 include left and right portions 80 and 82, respectively, oriented along generally curved lines. During a flame spread test the advance of the burning of the left portion 80 and the right portion 82 will be toward each other, and the propagation of the flames will be curled or directed towards each other to retard the extension of the flames beyond the adhesive ribbon. Therefore, a series of spaced apart, curved adhesive ribbons 34 will advantageously hinder the upward propagation or spread of flames from the bottom end 78 of the insulation assembly. Although the left and right portions 80 and 82 are shown as connected, they can be separated.

Figure 6:
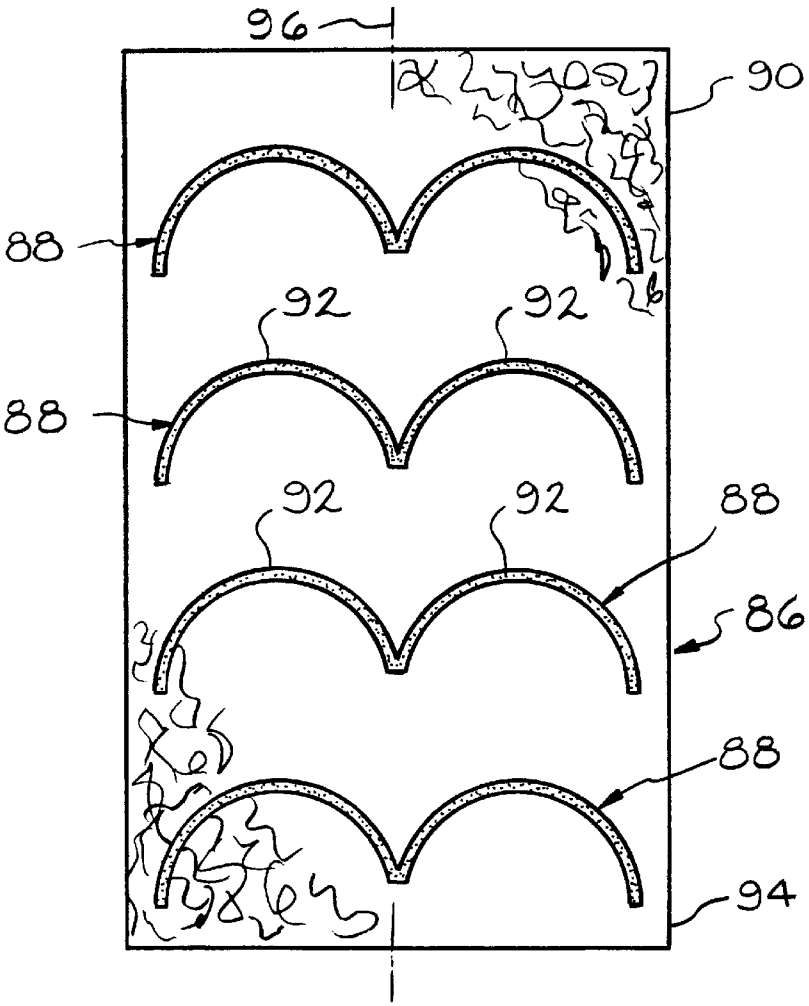
FIG. 6 is a schematic plan view similar to FIG. 4, illustrating yet another pattern of adhesive material according to the present invention.

As shown in FIG. 6, the insulation assembly 86 includes double curved adhesive ribbons 88 placed on the batt 90. Each of the curved sections 92 of the double curved ribbons is generally downwardly concave in shape, with the concave portion facing the bottom end 94 of the insulation assembly 86. The double curved ribbons 88 are preferably generally symmetric with respect to the longitudinal axis 96 of the insulation assembly. During a flame spread test the advance of the propagation of the flames will be curled or directed towards each other, in a manner described above with respect to FIG. 5, to retard the extension of the flames beyond the adhesive ribbon. Therefore, a series of spaced apart, double curved adhesive ribbons 88 will advantageously hinder the upward propagation or spread of flames from the bottom end 94 of the insulation assembly.

Figure 8:
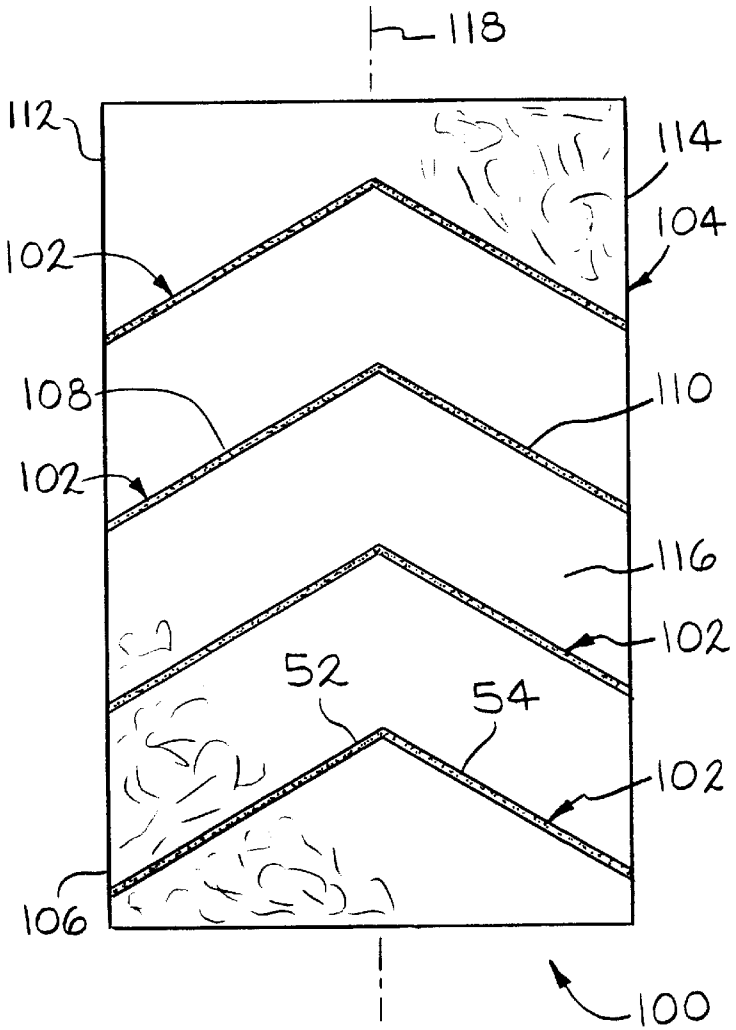
FIG. 8 is a schematic plan view similar to FIG. 4, illustrating a different pattern of adhesive material according to the present invention.

As shown in FIG. 8, the insulation assembly 100 is nearly identical to the insulation assembly 34 illustrated in FIGS. 3 and 4. Insulation assembly 100 includes chevron shaped adhesive ribbons 102 placed on the batt 104. The ribbons are generally downwardly concave in shape, with the concave portion facing the bottom end 106 of the insulation assembly 100. The adhesive ribbons 102 include left and right portions 108 and 110, respectively, oriented along generally straight lines. The ribbons 102 extend from edge 112 to edge 114 of the major face 116 of the batt 104, and are generally centered about longitudinal axis 118.

The principle and mode of operation of this invention have been described in its preferred embodiments. However, it should be noted that this invention may be practiced otherwise than as specifically illustrated and described without departing from its scope.

What is claimed is:

1. An insulation assembly comprising an elongated batt of fibrous insulation material having a top end and a bottom end, and a facing secured on a major surface, the facing being secured to the major surface by a series of spaced apart adhesive ribbons, wherein the adhesive ribbons are oriented generally transversely of the insulation assembly, and are nonlinear in a generally downwardly-oriented concave shape.

2. The insulation assembly of claim 1 wherein the ribbons include opposed left and right portions.

3. The insulation assembly of claim 2 in which the left and right portions are oriented along generally straight lines.

4. The insulation assembly of claim 3 in which the left and right portions are generally oriented at an angle within the range of from about 120 degrees to about 170 degrees with respect to each other.

5. The insulation assembly of claim 2 in which the left and right hand portions are connected to each other.

6. The insulation assembly of claim 2 in which the left and right portions are curved lines.

7. The insulation assembly of claim 6 in which the left and right hand portions are connected to each other.

8. The insulation assembly of claim 1 in which the ribbons are symmetrical with respect to a longitudinal axis of the insulation assembly.

9. The insulation assembly of claim 1 in which the adhesive ribbons extend from edge to edge of the major face of the batt.

10. An insulation assembly comprising an elongated batt of fibrous insulation material having a top end and a bottom end, and a facing secured on a major surface, the facing being secured to the major surface by a series of spaced apart adhesive ribbons, wherein the adhesive ribbons are oriented generally transversely of the insulation assembly, are nonlinear in a generally downwardly-oriented concave shape, and include opposed left and right portions connected together and oriented along generally straight lines.

11. The insulation assembly of claim 10 in which the left and right portions are generally oriented at an angle within the range of from about 120 degrees to about 170 degrees with respect to each other.

12. The insulation assembly of claim 10 in which the adhesive ribbons extend from edge to edge of the major face of the batt.

13. An insulation assembly comprising an elongated batt of fibrous insulation material having a top end and a bottom end, and a facing secured on a major surface, the facing being secured to the major surface by a series of spaced apart adhesive ribbons, wherein the adhesive ribbons are oriented generally transversely of the insulation assembly, are nonlinear in a generally downwardly-oriented concave shape, and include opposed left and right portions that are curved lines.

14. The insulation assembly of claim 13 in which the left and right hand portions are connected to each other.

15. The insulation assembly of claim 13 in which the ribbons are symmetrical with respect to a longitudinal axis of the insulation assembly.

16. The insulation assembly of claim 13 in which the adhesive ribbons extend from edge to edge of the major face of the batt.

* * * * *